United States Patent [19]

Schroeder

[11] 4,327,673

[45] May 4, 1982

[54] ENGINE COOLING SYSTEM

[76] Inventor: Elmer F. Schroeder, Box 6, Crescent Valley, Nev. 89821

[21] Appl. No.: 253,791

[22] Filed: Apr. 13, 1981

[51] Int. Cl.[3] ..... F01P 7/16

[52] U.S. Cl. ..... 123/41.08; 236/34.5

[58] Field of Search ..... 236/34, 34.5; 123/41.08; 237/12.3 B; 165/40

[56] References Cited

U.S. PATENT DOCUMENTS

| | | | |
|---|---|---|---|
| 1,286,993 | 12/1918 | Giesler | 236/34.5 |
| 1,332,332 | 3/1920 | Good | 123/41.08 |
| 1,406,922 | 2/1922 | Boyce | 237/12.3 B X |
| 1,863,437 | 6/1932 | Collier | 165/40 |
| 2,069,749 | 2/1937 | Brubaker | 123/41.08 |
| 3,981,279 | 9/1976 | Bubniak et al. | 123/41.08 X |

*Primary Examiner*—William E. Tapolcai, Jr.
*Attorney, Agent, or Firm*—Vernon D. Beehler

[57] ABSTRACT

The invention makes use of a second thermostat in an engine cooling system, normally equipped with only a single thermostat. The second thermostat differs from the single thermostat in that provision is made for a constant, though materially diminished, flow of coolant past the second thermostat which, when the need arises, is converted to full flow by action of the second thermostat.

7 Claims, 6 Drawing Figures

Fig. 1.
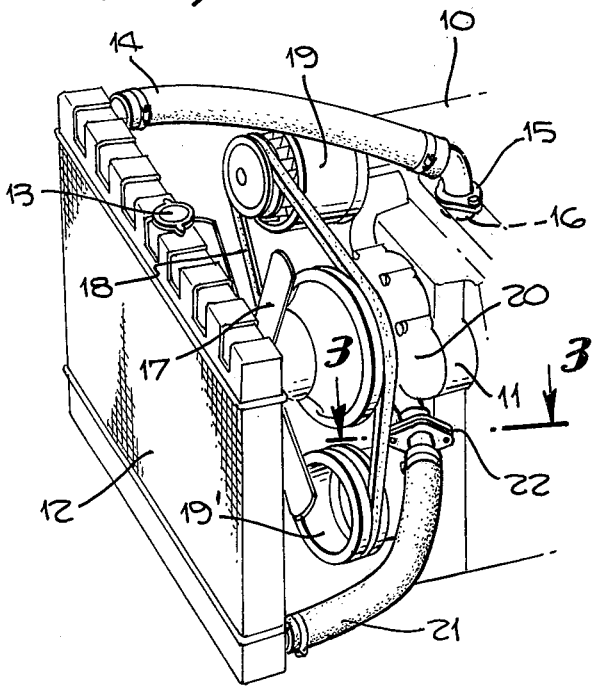
Fig. 2. PRIOR ART
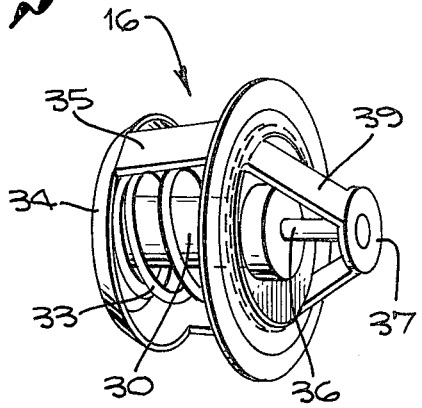
Fig. 5.
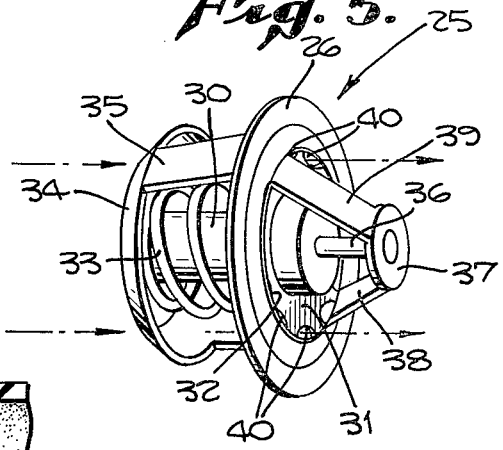
Fig. 3.
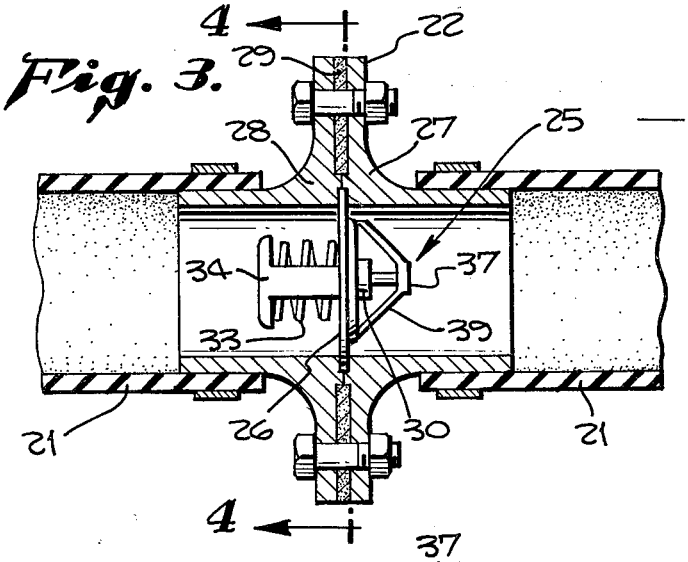
Fig. 6.
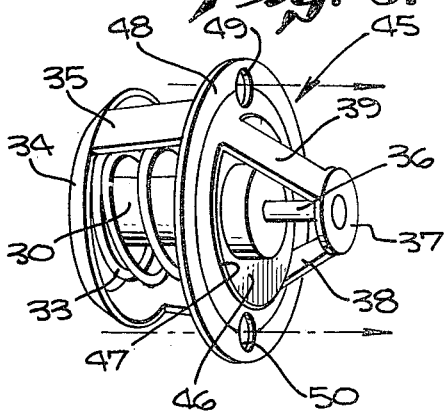
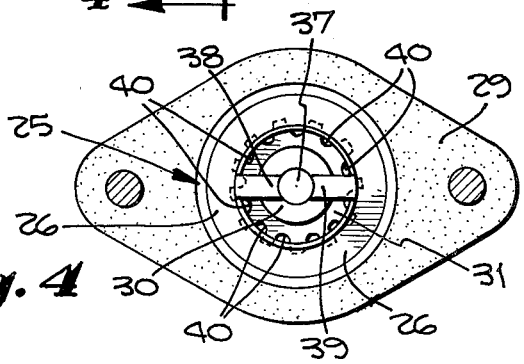
Fig. 4

ENGINE COOLING SYSTEM

For normal cooling of a combustion engine a finned radiator is provided, connected at the top of the radiator by an outflow line to the cooling jacket of the engine at an upper level and at the bottom of the radiator by an inflow line to the cooling jacket at a lower level. A fan is customarily mounted to move air past the radiator fins and a coolant pump keeps the coolant moving.

Although a combustion engine needs a cooling system for constant operation to prevent it from overheating, the engine is designed to operate normally in a heated condition. Consequently when a cold engine is to be started it will operate better if circulation of the coolant is temporarily delayed. To accomplish such a delay a thermostat activated valve is installed in the outflow line which holds the line in a shut off condition until the temperature of the coolant in the jacket reaches a rating of between about 160° F. and 190° F.

Under normal temperature conditions the cooling systems presently in use perform satisfactorily. The engine warms to operating temperature promptly and, in cooler seasons of the year, heat is promptly available to operate the heater in the cab.

Where the system commences to be deficient in performance occurs when air temperature drops to 32° F. and lower. Below zero fahrenheit serious difficulties are frequently encountered. Engines do not warm up to optimum operating temperature resulting in loss of horsepower and low efficiency, and cab heaters fail to perform.

To remedy the situation in the past resort has been had to sundry devices for damping off part of the flow of frigid air over the radiator fins. One remedy has been to provide adjustable louvers behind the conventional radiator. Another has been to provide a shield of some kind extending over part of the radiator to cut down on the amount of cold air flowing over the fins. Such remedies have been at best a stop gap in that they make no ready provision for resumption of normal air flow in case of changes in the weather.

It is therefore among the objects of the invention to provide a new and improved cooling system for a combustion engine which enhances the cooling program for the engine when operating in temperatures well below the normal range.

Another object of the invention is to provide a new and improved cooling system for combustion engines which operates effectively and continuiously when required under colder temperature conditions than normal and at the same time makes relatively little or no change in conventional portions of the cooling system.

Still another object of the invention is to provide a new and improved cooling system for combustion engines which operates effectively in temperatures lower than normal without disturbing operation of the system under normal conditions and which is simple in its construction, relatively inexpensive, and adapted for installation by a person of no more than modest skill.

Still further among the objects of the invention is to provide a new and improved cooling system for combustion engines which, though simple in its construction and direct in its operation, is capable of adapting itself to operation under wide ranges of temperature variation without need for special adjustment and which is of such character that it operates relatively quickly when called upon so that not only is the combustion engine itself brought up to normal operating temperature but any equipment such as the heater in the cab of a truck dependent for its operation upon a warm engine is quickly placed in operation under circumstances where the temperature of the surrounding air might be appreciably below the normal operating level.

With these and other objects in view the invention consists of the construction, arrangement and combination of the various parts of the device serving as an example of only one or more embodiments of the invention whereby the objects contemplated are attained as hereinafter disclosed in the specification and drawings and pointed out in the appended claims.

FIG. 1 is a perspective view of a typical combustion engine showing coolant lines and the location of a thermostat activated valve. FIG. 2 is an end perspective view of a conventional thermostat activated valve of the type used in coolant lines for combustion engines.

FIG. 3 is a longitudinal sectional view of a thermostat activated valve on the line 3—3 of FIG. 1.

FIG. 4 is a cross sectional view on the line 4—4 of FIG. 3.

FIG. 5 is an end perspective view of the thermostat activated valve of one form of the invention.

FIG. 6 is an end perspective view of the thermostat activated valve of another form of the invention.

In FIG. 1 is shown a typical combustion engine cooling set-up comprising the combustion engine 10 within a cooling jacket, a fragment 11 of which is shown. Adjacent the engine is a conventional radiator 12 with its fill cap 13 on top and connected by means of a hot outflow coolant line 14 through a fitting 15 to the jacket 11. The fitting 15 is normally one providing a mounting for a conventional thermostat activated valve 16 of the type shown in FIG. 2. Following conventional practice there is a fan 17 driven by a belt 18 from a motor 19. A coolant pump 20 attached to the forepart of the jacket 11 is shown, in the typical example, driven by the same belt 18 through a pulley 19'. A cool coolant inflow line 21 connected at one end to the bottom of the radiator 12 returns the coolant to the pump 20, and through this agency to the cooling jacket 11. A fitting 22 is provided in the cool coolant return line 21 for mounting one form of the thermostat activated valve 25 of the invention.

As shown in FIG. 5, there is an annular flange 26 confined between fitting components 27 and 28 in a manner making it possible to provide a sealing gasket 29.

The thermostat activated valve 25 itself comprises a heat sensitive cartridge 30 on one side which carries a valve element 31 adapted to engage a valve seat 32 when moving from left to right as viewed in FIGS. 3 and 5. The valve element 31 is urged against the valve seat 32 by action of a coiled spring 33 acting at its opposite end against a spring keeper 34 which is part of a bracket 35. The cartridge 30, which extends entirely through the valve element 31, is provided at its opposite, or right hand end then viewed in FIG. 5, with a guide pin 36 centerably and slidably retained in a guide ring 37 supported in position on legs 38 and 39 in turn carried by the flange 26 as is the bracket 35.

Of special consequence is the provision of a plurality of circumferentially spaced slots 40 in the valve element 31. These slots provide for a constant flow of coolant past the thermostat activated valve 25 as the coolant returns from the radiator 12 through the cool coolant line 21 to the pump 20. When more coolant is called for by the temperature condition of coolant on the engine side of the thermostat activated valve 25, the cartridge acts in a direction to lift the valve element 31 from the valve seat 32 a distance sufficient to allow full flow of the coolant through the return line 21 to the full capacity of the line. Good practice indicates that the constant flow provided for by the slots 40 should be approximately from 20 to 25 percent of the capacity of the return line 21.

In the form of invention of FIG. 6 there is shown a thermostat activated valve 45 wherein an annular valve element 46, seating upon a corresponding annular valve seat 47 provides a complete shut off at the valve seat. In a flange 48, however, there are provided holes 49 and 50 which bypass the valve seat and provide for a constant flow of coolant past the thermostat activated valve 45 irrespective of temperature conditions. Although two holes 49 and 50 are shown the form and number in a matter on convenience and economy, such holes being subject to drilling. Holes of other shape, size and distribution can be provided through the flange 48, the aggregate full capacity of which should be in the range of 20 to 25 percent of the full capacity of the line 21.

In operation, and as shown, the thermostatic activated valve of the invention is located in the return line 21. As such it can readily be retrofit to virtually all existing combustion engine set-ups. Improved results for original installation can be had where there is a suitable fitting provided on the housing of the pump so as to bring the heat responsive cartridge at the closest possible location with respect to the cooling jacket of the engine.

In operation the conventional thermostat activated valve 16 is normally set for opening at a temperature somewhere between about 160 and 190 degrees F. Settings are established when the installation is made and not subject to ready readjustment in the field. Under such circumstances, the thermostat activated valve 25 or 45 of the invention is set to open at approximately the same temperature at which the thermostat activated valve 16 is set, or slightly lower. Under such circumstances, and where the radiator is being subjected to air temperatures of something in the neighborhood of 32 degrees F. or substantially lower such that the coolant after passing through the radiator is cooled down to a unnecessarily low temperature, flow of the coolant back into the circulating pump and engine jacket is substantially prevented except for the calculated constant flow bypass until the engine is brought up to temperature, after which by the opening of the thermostat activated valve 25, or 45 as the case may be, full flow of coolant back into the engine is provided for.

I claim:

1. A system for embodiment in a cooling circuit for a combustion engine in which the circuit makes use of a cooling jacket for the engine, a radiator, a hot coolant outflow line from the jacket to the radiator, a cool coolant inflow line from the radiator to the jacket and a circulating pump in said circuit, said system comprising a first thermostat activated valve device in said outflow line triggered to operate at a selected temperature, a second thermostat activated valve device in said inflow line triggered to operate at a selected temperature, said first valve device when in normal position having a full shut-off adjacent and when triggered to operate having a full flow adjustment, said second valve device when in normal position having a partial flow adjustment and when triggered to operate having a full flow adjustment.

2. A system as in claim 1 wherein said second thermostat activated valve device is at a location between the radiator and the jacket.

3. A system as in claim 2 wherein the circulating pump is at a location between the second thermostat activated valve device and the jacket.

4. A system as in claim 1 wherein said partial flow adjustment is at about $\frac{1}{4}$ the full flow capacity of said inflow line.

5. A system as in claim 1 wherein there is a bypass passage in said second thermostat activated valve device for said partial flow adjustment.

6. A system as in claim 1 wherein said second thermostat activated valve device comprises, a valve seat and valve element, said partial flow adjustment comprising a partial flow passage means through said valve element.

7. A system as in claim 1 wherein said second thermostat activated valve device and said first thermostat activated valve device are triggered to operate at substantially the same temperature.

* * * * *